US005516609A

United States Patent [19]

Daimon et al.

[11] Patent Number: 5,516,609

[45] Date of Patent: May 14, 1996

[54] METHOXY GALLIUM PHTHALOCYANINE COMPOUND AND ELECTROPHOTOGRAPHIC PHOTORECEPTOR USING IT

[75] Inventors: Katsumi Daimon; Ryosaku Igarashi, both of Minami Ashigara, Japan

[73] Assignee: Fuji Xerox Co., Ltd., Tokyo, Japan

[21] Appl. No.: 220,164

[22] Filed: Mar. 30, 1994

[30] Foreign Application Priority Data

Apr. 2, 1993 [JP] Japan ..... 5-098349

[51] Int. Cl.[6] ..... G03G 5/08

[52] U.S. Cl. ..... 430/58; 430/78; 540/140

[58] Field of Search ..... 430/78, 58; 540/139, 540/140

[56] References Cited

U.S. PATENT DOCUMENTS

| | | | |
|---|---|---|---|
| 2,770,629 | 11/1956 | Eastes . | |
| 3,160,635 | 12/1964 | Knudsen et al. . | |
| 3,357,989 | 12/1967 | Byrne et al. . | |
| 3,708,292 | 1/1973 | Brach et al. . | |
| 4,886,721 | 12/1989 | Hayashida et al. | 430/78 |

FOREIGN PATENT DOCUMENTS

| | | |
|---|---|---|
| 48-34189 | 5/1973 | Japan . |
| 49-105536 | 1/1974 | Japan . |
| 50-38543 | 4/1975 | Japan . |
| 57-148745 | 9/1982 | Japan . |
| 58-21416 | 2/1983 | Japan . |
| 59-133551 | 7/1984 | Japan . |
| 60-59354 | 4/1985 | Japan . |
| 61-151659 | 7/1986 | Japan . |
| 1-221459 | 9/1989 | Japan . |
| 3-30853 | 5/1991 | Japan . |
| 3-30853 | 5/1991 | Japan . |
| 4-97994 | 3/1992 | Japan . |

OTHER PUBLICATIONS

Chemical Abstracts 118:245199 (1992).

Translation of JP 4–97994 (1992).

Kittel, Charles. *Introduction to Solid State Physics,* New York: John Wiley & Sons, Inc., 1986, pp. 204–205.

Linsky, John P. et al., "Studies of a Series of Haloaluminum, –gallium, and–Indium Phthalocyanines," *Inorg. Chem.,* 1980, 19, 3131–3135.

Colaitis, D., "No. 2–Etude de quelques derives de la phtalocyanine discussion des divers modes d'obtenion, 1.–Phtalocyanines d'elements de valence superieure a deux," *Bull. Soc. Chim. France,* 23 (1962).

*Primary Examiner*—Christopher D. Rodee

*Attorney, Agent, or Firm*—Oliff & Berridge

[57] ABSTRACT

A methoxy gallium phthalocyanine compound represented by formula (I):

(I)

wherein X represents a chlorine atom, a bromine atom, or an iodine atom; and n represents an integer of from 0 to 4; and an electrophotographic photoreceptor using the methoxy gallium phthalocyanine compound.

10 Claims, 2 Drawing Sheets

METHOXY GALLIUM PHTHALOCYANINE COMPOUND AND ELECTROPHOTOGRAPHIC PHOTORECEPTOR USING IT

FIELD OF THE INVENTION

The present invention relates to a novel gallium phthalocyanine compound useful as an electrophotographic photosensitive material, a material for a photoelectric conversion element, a material for an organic semiconductor element, a light recording material, and a catalyst. The present invention also relates to an electrophotographic photoreceptor using the compound.

BACKGROUND OF THE INVENTION

Phthalocyanine compounds are useful materials as a paint, a printing ink, a catalyst, and an electronic material, and recently phthalocyanine compounds have been widely investigated as a material for an electrophotographic photoreceptor, a material for a photo-recording material and a material for a photoelectric conversion element.

In the field of an electrophotographic photosensitive material, there has been recently demanded that the photosensitive wavelength region of organic photoconductive materials which are hitherto been proposed is extended to the wavelength (780 to 830 nm) of a near infrared semiconductor laser, so as to use them as an electrophotographic photosensitive material for a photoreceptor for digital recording such as laser printer, etc. From the view point, squarylium compounds (as described in JP-A-49-105536 and JP-A-58-21416), triphenylamine series trisazo compounds (as described in JP-A-61-151659), phthalocyanine compounds (as described in JP-A-48-34189 and JP-A-57-148745), etc., have been proposed as organic photoconductive materials for semiconductor laser. The term "JP-A" as used herein means an "unexamined published Japanese patent application".

When an organic photoconductive material is used as a photosensitive material for semiconductor laser, it is required that the light-sensitive wavelength region extends to a long wavelength region, and the electrophotographic photoreceptor formed has a high sensitivity and a good durability. However, the organic photoconductive materials described above do not sufficiently meet these requirements.

For overcoming the above faults of the foregoing organic photoconductive materials, the relationships between the crystal forms and the electrophotographic characteristics have been investigated and, in particular, many reports have been made with respect to phthalocyanine compounds.

It is known that phthalocyanine compounds generally show various crystal forms according to the differences of the production methods and the treatment methods and it is also known that the difference in the crystal forms gives a large influence on the photoelectric conversion characteristics of the phthalocyanine. In regard to the crystal forms of copper phthalocyanine compounds, the crystal forms of $\alpha$, $\pi$, $\chi$, $\rho$, $\gamma$, $\delta$, etc., are known in addition to the stable $\beta$ form and it is known that these crystal forms can be transformed to each other by a mechanical strain force, a sulfuric acid treatment, an organic solvent treatment, a heat treatment, etc., as described, e.g., in U.S. Pat. Nos. 2,770,629, 3,160,635, 3,708,292, and 3,357,989. JP-A-50-38543 describes the relationship between the difference in the crystal form of copper phthalocyanine and the electrophotographic sensitivity. Furthermore, gallium phthalocyanine is described in JP-B-3-30853 and JP-B-3-30854 (the "JP-B" as used herein means an "examined published Japanese patent application") and also the electrophotographic characteristics of the crystal forms thereof are described in JP-A-1-221459.

However, when not only the foregoing crystal forms of gallium phthalocyanine but also conventionally proposed phthalocyanine compounds are used as photosensitive materials for electrophotographic photoreceptors, the light sensitivity and the durability are yet insufficient.

Accordingly, the development of novel phthalocyanine compounds suitable for photosensitive materials having improved light sensitivity and the durability while utilizing the features of the foregoing phthalocyanine compounds has been desired. The present invention has been made for solving the foregoing problems in the conventional techniques.

SUMMARY OF THE INVENTION

An object of the present invention is to provide a novel methoxy gallium phthalocyanine compound and novel crystals thereof.

Another object of the present invention is to provide an electrophotographic photoreceptor having a high sensitivity and a high durability using the novel methoxy gallium phthalocyanine compound.

Other objects and effects of the present invention will be apparent from the following description.

The present invention relates to a methoxy gallium phthalocyanine compound represented by formula (I):

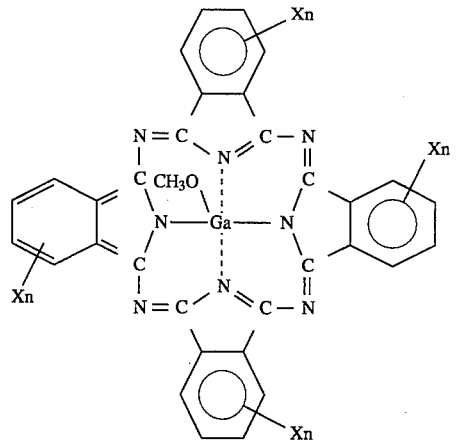

(I)

wherein X represents a chlorine atom, a bromine atom, or an iodine atom; and n represents an integer of from 0 to 4. The values of the plurality of n may be the same or different.

The present invention also relates to an electrophotographic photoreceptor comprising an electrically conductive support having thereon a photosensitive layer comprising the above methoxy gallium phthalocyanine compound represented by formula (I) as a charge generating material.

DETAILED DESCRIPTION OF THE INVENTION

Figure 1:
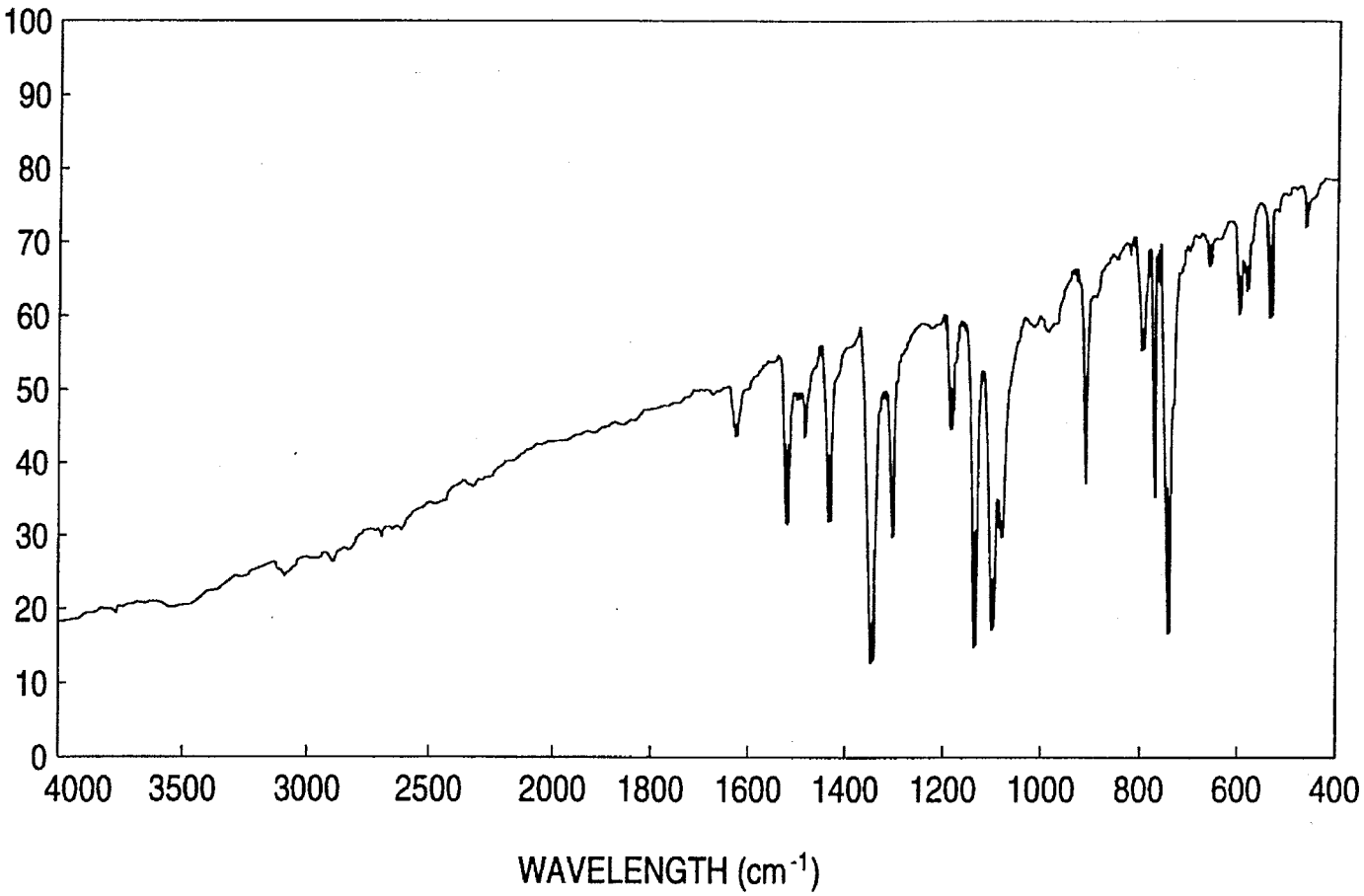
FIG. 1 shows an IR absorption spectrum of a methoxy gallium phthalocyanine crystal obtained in Example 1.

The methoxy gallium phthalocyanine compound represented by formula (I) described above is a novel compound.

Specific examples of the methoxy gallium phthalocyanine compound of the present invention include methoxy gallium phthalocyanine and a halogen-substituted methoxy gallium phthalocyanine, such as chlorine-substituted methoxy gallium phthalocyanine, bromine-substituted methoxy gallium phthalocyanine, and iodine-substituted methoxy gallium phthalocyanine.

Among the methoxy gallium phthalocyanine compound according to the present invention, those represented by formula (II) are preferred:

(II)

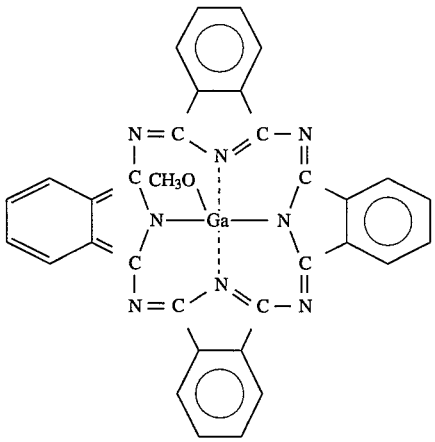

The methoxy gallium phthalocyanine compound of the present invention preferably has a distinct absorption peak at 558 $cm^{-1}$ in an IR absorption spectrum.

The methoxy gallium phthalocyanine compound of the present invention is preferably a methoxy gallium phthalocyanine crystal having distinct diffraction peaks at Bragg angles (2θ±0.2°) of 7.7°, 16.5°, 25.1°, and 26.6° to CuKα characteristic X-ray in the X-ray diffraction spectrum.

Among the methoxy gallium phthalocyanine crystal according to the present invention, those represented by formula (II) above are preferred. The methoxy gallium phthalocyanine crystal according to the present invention preferably has a distinct absorption peak at 558 $cm^{-1}$ in an IR absorption spectrum.

The methoxy gallium phthalocyanine compound of the present invention can be produced by the following manner: A gallium phthalocyanine having a halogen atom, etc., as a ligand, is hydrolyzed to produce hydroxy gallium phthalocyanine, and the resulting hydroxy gallium phthalocyanine is then treated with methanol to produce the desired methoxy gallium phthalocyanine.

Examples of the gallium phthalocyanine having a halogen atom, etc., as a ligand, to be hydrolyzed include chlorogallium phthalocyanine, bromogallium phthalocyanine, iodogallium phthalocyanine, etc., but the ligand on gallium is not limited to a halogen atom.

These gallium phthalocyanines can be synthesized by any known methods. For example, chlorogallium phthalocyanine can be produced by a method of reacting gallium trichloride and diiminoisoindoline described in *D.C.R. Acad. Sci.*, 242, 1026 (1956); bromogallium phthalocyanine can be produced by a method of reacting gallium tribromide and phthalonitrile described in JP-A-59-133551; and iodogallium phthalocyanine can be produced by a method of reacting gallium triiodide and phthalonitrile described in JP-A-60-59354.

The method for hydrolysis of these gallium phthalocyanines is not particularly limited, and may be conducted by an acid hydrolysis such as an acid pasting method, or an alkaline hydrolysis.

In the case of acid pasting method, hydroxy gallium phthalocyanine can be obtained by hydrolyzing chlorogallium phthalocyanine using sulfuric acid, as described, e.g., in *Bull. Soc. Chim. France,* 23 (1962). In the case of using an alkaline hydrolysis method, hydroxy gallium phthalocyanine can be obtained by hydrolysing chlorogallium phthalocyanine using ammonia, as described, e.g., in *Inorg. Chem.*, (19) 3131 (1980). Among the above, the acid pasting method is preferred, but the hydrolysis method is not limited to the methods described above.

The resulting hydroxy gallium phthalocyanine is then treated with methanol to obtain the desired methoxy gallium phthalocyanine compound. Specifically, hydroxy gallium phthalocyanine can be dispersed and stirred in methanol at a temperature of from room temperature to the boiling point of methanol, and preferably from 20° to 40° C., for from 0.5 to 100 hours, and preferably from 5 to 30 hours. The amount of methanol is generally of from 1 to 100 times by weight, and preferably from 5 to 30 times by weight, the amount of hydroxy gallium phthalocyanine. By the methanol treatment, desired methoxy gallium phthalocyanine of the present invention represented by formula (I) can be obtained.

The electrophotographic photoreceptor of the present invention using the methoxy gallium phthalocyanine compound is then explained below.

The electrophotographic photoreceptor of the present invention comprises an electrically conductive support having thereon a photosensitive layer. The photosensitive layer may have a single layer structure or a laminated layer structure comprising a charge generating layer and a charge transfer layer, with the laminated layer structure being preferred. When the photosensitive layer has a laminated layer structure, it is general that a charge generating layer is formed on a electrically conductive support, and a charge transfer layer is further formed on the charge generating layer, but the photosensitive layer may have the reverse structure in which a charge generating layer is formed on a charge transfer layer.

In the present invention, as the electrically conductive support, any known supports for electrophotographic photoreceptors can be used. Examples there of include a drum or a sheet of a metal such as aluminum, stainless steel, etc., laminated materials of these metal foils, and vapor-deposited materials with such metals. Examples thereof also include plastic films, plastic drums, papers, paper tubes, etc., each is subjected to an electric conductive treatment by coating an electrically conductive material such as a high molecular electrolyte, etc., together with a binder; and plastic sheets and drums each is rendered electric conductive by containing an electric conductive material such as a metal powder, carbon black, carbon fibers, etc. Furthermore, plastic films and belts treated with an electrically conductive metal oxide such as tin oxide, indium oxide, etc., may be used.

The charge generating layer is formed by dispersing the methoxy gallium phthalocyanine compound, which is a charge generating material, in a solution formed by dissolving a binder resin in an organic solvent to prepare a coating composition and coating the coating composition on an electrically conductive support followed by drying.

As the binder resin, various kinds of resins, such as a polyvinyl butyral resin, polyvinyl formal resin, etc., can be used. As an organic solvent for dissolving the binder resin, it is preferred to select it from organic solvents that do not dissolve an underlayer formed on the support.

The compounding ratio of the methoxy gallium phthalocyanine compound to the binder resin is generally in the range of from 40/1 to 1/20 by weight.

As a method of dispersing the methoxy gallium phthalocyanine compound in the binder resin to prepare a coating composition, an ordinary method such as a ball mill dispersion method, an attritor dispersion method, a sand mill dispersion method, etc., can be employed.

For coating the coating composition, a coating method such as a dip coating method, a spray coating method, a spinner coating method, a bead coating method, a wire bar coating method, a blade coating method, a roller coating method, an air knife coating method, a curtain coating method, etc., can be employed.

The thickness of the charge generating layer is generally from about 0.05 to 5 μm.

The charge transfer layer can be provided by forming a layer of a suitable binder resin containing a charge transfer material, such as N,N'-diphenyl-N,N'-bis-(m-tolyl)-benzidine, 4-diethylaminobenzaldehyde-2,2-diphenylhydrazone, p-(2,2-diphenylvinyl)-N,N-diphenylaniline, etc.

The charge transfer layer can be formed by preparing a coating composition comprising the charge transfer material together with the binder resin and an organic solvent. As the binder resin and the organic solvent, those used for forming the charge generating layer described above can also be used. As the method for preparing the coating composition and the method for coating the coating composition, those described for the charge generating layer may be used.

The compounding ratio of the charge transfer material to the binder resin is generally from 10/1 to 1/5 by weight. The thickness of the charge transfer layer is generally in the range of from about 5 to 50 μm.

In the electrophotographic photoreceptor of the present invention, when the photosensitive layer is composed of a photoconductive layer of a single layer structure, the photosensitive layer may be formed by using a coating composition prepared by dispersing the methoxy gallium phthalocyanine compound in the mixture of a charge transfer material and a binder resin. As the charge generating material and the binder resin, the same materials as in the case of the laminated layer structure as described above can be used. The photoconductive layer of the single layer structure can be formed according to the same dispersion and coating methods as described above. In this case, it is preferred that the compounding ratio of the charge transfer material to the binder resin is from 1/20 to 5/1 by weight, and the compounding ratio of the methoxy gallium phthalocyanine compound to the charge transfer material is from about 1/10 to 10/1 by weight.

In the present invention, for preventing the injection of unnecessary electrostatic charges from the electrically conductive support into the photosensitive layer at electrostatially charging, it is preferred to form a subbing layer comprising a polyamide resin, a polycarbonate resin, a zirconium chelate compound, a titanyl chelate compound, etc., between the electrically conductive support and the photosensitive layer.

Furthermore, if desired, a protective layer may be formed on the surface of the photosensitive layer. The protective layer formed has a function of preventing the occurrence of a chemical change in quality of the charge transfer layer at electrostatically charging the photosensitive layer and also improving the mechanical strength of the photosensitive layer.

The present invention is described more practically by the following examples. All parts in these examples, unless otherwise indicated, are by weight.

EXAMPLE 1

To 100 ml of α-chloronaphthalene were added 10 parts of gallium trichloride and 29.1 parts of o-phthalonitrile, and they are reacted for 24 hours at 200° C. in a nitrogen gas stream. Chlorogallium phthalocyanine crystals thus formed were collected by filtration. The wet cake of chlorogallium phthalocyanine crystals thus obtained was dispersed in 100 ml of N,N-dimethylformamide followed by stirring under heating to 150° C. for 30 minutes, and after collecting the crystals by filtration, the crystals were sufficiently washed with methanol and dried to provide 28.9 parts (yield: 82.5%) of chlorogallium phthalocyanine crystals.

2 parts of chlorogallium phthalocyanine obtained was dissolved in 50 parts of concentrated sulfuric acid and after stirring the solution for 2 hours, the solution was added dropwise to a mixed solution of 170 ml of ice-cooled distilled water and 66 ml of a concentrated aqueous ammonia to deposit crystals. The crystals thus deposited were collected, sufficiently washed with distilled water, and dried to provide 1.8 parts of hydroxy gallium phthalocyanine crystals.

1 part of the hydroxy gallium phthalocyanine crystals thus obtained was added to 15 parts of methanol, and the resulting mixture was stirred for 24 hours at room temperature. The product thus formed was separated and dried to provide 0.95 part of methoxy gallium phthalocyanine crystals.

Figure 2:
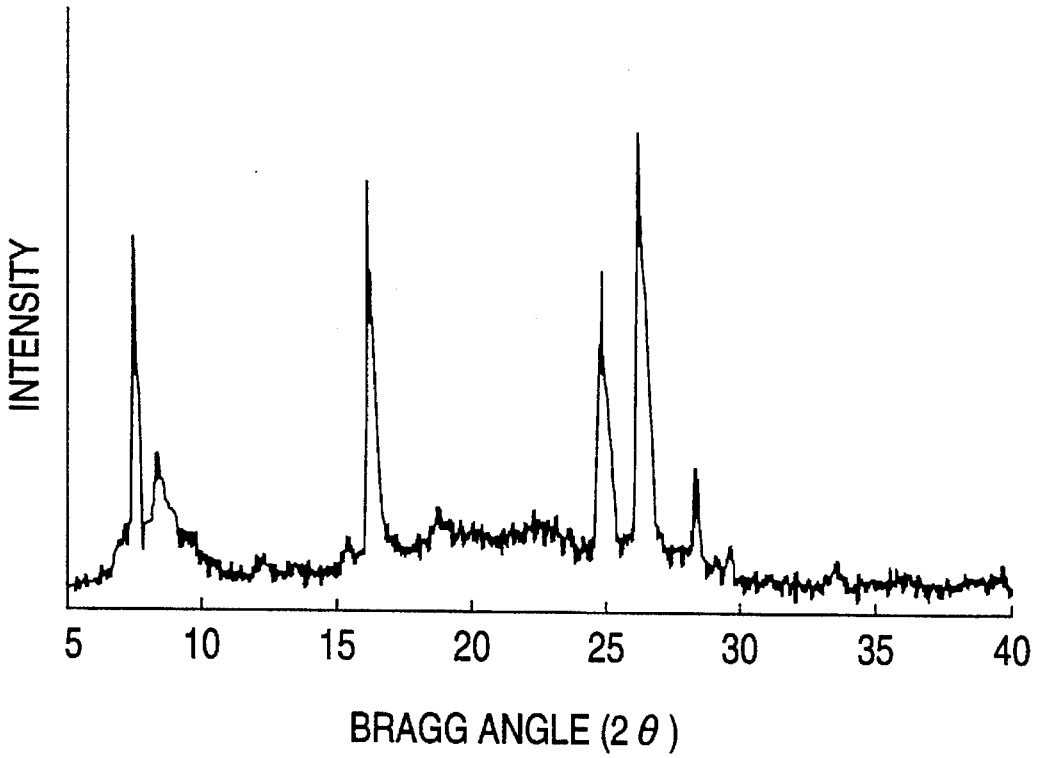
FIG. 2 shows a powder X-ray diffraction spectrum of the methoxy gallium phthalocyanine crystal obtained in Example 1.

The molecular weight of the crystals confirmed by an FD-Mass spectral analysis was 612. The elemental analysis value of the crystal is shown in Table 1 below, the IR spectrum thereof is shown in FIG. 1, and the powder X-ray diffraction spectrum is shown in FIG. 2. In the IR spectrum shown in FIG. 1, a distinct absorption peak at 558 $cm^{-1}$ was found. In the powder X-ray diffraction spectrum shown in FIG. 2, distinct diffraction peaks at Bragg angles (2θ±0.2°) of 7.7°, 16.5°, 25.1°, and 26.6° were found.

TABLE 1

| | (Results of elemental analysis) | | |
|---|---|---|---|
| | C (%) | H (%) | N (%) |
| Calculated | 64.63 | 3.12 | 18.27 |
| Found | 64.36 | 3.25 | 17.93 |

EXAMPLE 2

A mixture of 31.8 parts of phthalonitrile, 10.1 parts of gallium trimethoxide, and 150 ml of ethylene glycol was stirred for 24 hours at 200° C. in a nitrogen gas stream, and gallium phthalocyanine crystals thus formed were collected by filtration. The crystals were successively washed with N,N-dimethylformamide and then methanol, and dried to provide 25.1 parts of gallium phthalocyanine.

2 parts of gallium phthalocyanine obtained was dissolved in 50 parts of concentrated sulfuric acid, and after stirring the solution for 2 hours, the solution was added dropwise to an ice-cooled mixed solution of 75 ml of distilled water, 75 ml of a concentrated aqueous ammonia, and 450 ml of acetone to deposit crystals. The crystals deposited were collected, sufficiently washed with distilled water, and dried to provide 1.8 parts of hydroxy gallium phthalocyanine crystals.

A mixture of 1 part of the hydroxy gallium phthalocyanine crystals thus obtained and 15 parts of methanol was stirred for 24 hours, and the product formed was separated and dried to provide 0.95 part of methoxy gallium phthalocyanine crystals.

The molecular weight of the crystal by an FD-Mass spectral analysis, the IR spectrum thereof, and the powder X-ray diffraction spectrum thereof were the same as those of the crystals obtained in Example 1.

EXAMPLE 3

On an aluminum plate, as an electrically conductive support, was coated a solution composed of 10 parts of a zirconium compound (Orgatix ZC540, trade name, made by Matsumoto Seiyaku K. K.), 1 part of a silane compound (A1110, trade name, made by Nippon Unicar K. K.), 40 parts of i-propanol, and 20 parts of butanol by a dip coating method, and the coated layer was dried at 150° C. for 10 minutes to form a subbing layer of 0.2 μm in thickness.

A mixture of 1 part of methoxy gallium phthalocyanine obtained in Example 1, 1 part of a polyvinyl butyral resin (S-Lec BM-S, trade name, made by Sekisui Chemical Co., Ltd.), and 100 parts of n-butyl acetate was dispersed together with glass beads by a paint shaker for one hour, and the resulting coating composition was coated on the foregoing subbing layer by a dip coating method and dried at 100° C. for 10 minutes to form a charge generating layer.

2 parts of a charge transfer material shown by formula (III) below and 3 parts of a polycarbonate resin having a repeating unit shown by formula (IV) below were dissolved in 20 parts of monochorobenzene to provide a coating composition. The coating composition obtained was coated on the charge generating layer formed on the aluminum support by a dip coating method and dried at 120° C. for one hour to form a charge transfer layer of 20 μm in thickness. Thus, an electrophotographic photoreceptor according to the present invention was prepared.

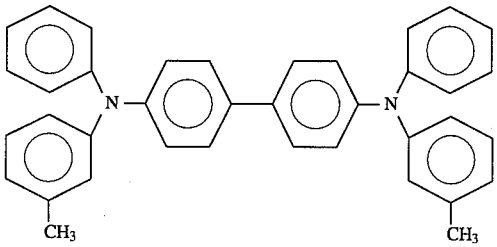

(III)

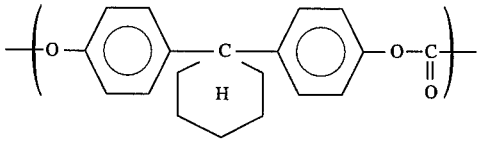

(IV)

The electrophotographic characteristics of the resulting electrophotographic photoreceptor were measured in the following manner: The electrophotographic photoreceptor was electrostatically charged to $V_0$ (V) by applying thereto corona discharging of −2.5 μA under the circumstance of normal temperature and normal humidity (20° C., 40%RH) using a flat plate scanner (manufactured by Fuji Xerox Co., Ltd.), and after allowing to stand it for one second, the photoreceptor was irradiated by a monochromatic light of 780 n.m. obtained by adjusting light from a tungsten lamp using a monochrometer by controlling such that the illuminance thereof became 0.25 μW/cm$^2$ on the surface of the photoreceptor. The exposure amount ($E_{1/2}$) that the surface potential became ½ of the initial surface potential was then measured. The results are shown in Table 2 below.

EXAMPLE 4

By following the same procedure as in Example 3 except that methoxy gallium phthalocyanine obtained in Example 2 was used in place of the methoxy gallium phthalocyanine obtained in Example 1, an electrophotographic photoreceptor was prepared and the electrophotographic characteristics were evaluated in the same manner as in Example 3. The results obtained are shown in Table 2 below.

COMPARATIVE EXAMPLE 1

By following the same procedure as in Example 3 except that an χ-type metal free phthalocyanine was used in place of the methoxy gallium phthalocyanine, an electrophotographic photoreceptor was prepared and the electrophotographic characteristics were evaluated in the same manner as in Example 3. The results obtained are shown in Table 2 below.

TABLE 2

| | Charge generating material | $V_0$ (V) | $E_{1/2}$ (μW · S/cm$^2$) |
|---|---|---|---|
| Example 3 | Example 1 | −555 | 0.2 |
| Example 4 | Example 2 | −545 | 0.2 |
| Comparative Example 1 | χ-type metal free phthalocyanine | −567 | 0.5 |

The novel methoxy gallium phthalocyanine compound of the present invention is useful as a charge generating material in an electrophotographic photoreceptor, a material for a photoelectric conversion element, a material for an organic semiconductor element, a photo-recording material, and a catalyst, and the electrophotographic photoreceptor of the present invention using the methoxy gallium phthalocyanine compound has a high light sensitivity and also is excellent in stability.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising an electrically conductive support having thereon a photosensitive layer comprising a binder resin and a methoxy gallium phthalocyanine compound represented by formula (I) as a charge generating material:

(I)

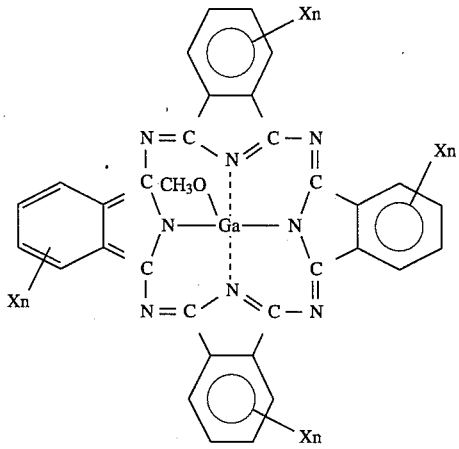

wherein X represents a chlorine atom, a bromine atom, or an iodine atom; and n represents an integer of from 0 to 4.

2. An electrophotographic photoreceptor as claimed in claim 1, wherein said methoxy gallium phthalocyanine compound is represented by formula (II):

(II)

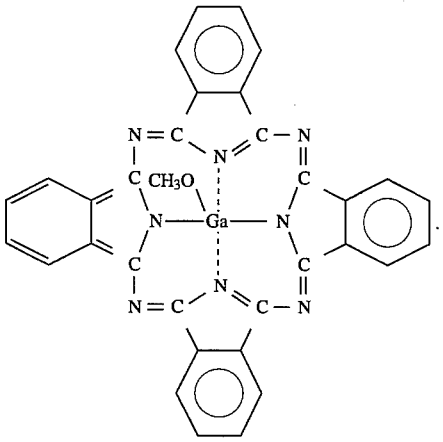

3. An electrophotographic photoreceptor as claimed in claim 1, wherein said methoxy gallium phthalocyanine compound has a distinct absorption peak at 558 $cm^{-1}$ in an IR absorption spectrum.

4. An electrophotographic photoreceptor as claimed in claim 1, wherein said methoxy gallium phthalocyanine compound is a methoxy gallium phthalocyanine crystal having distinct diffraction peaks at Bragg angles (2θ±0.2°) of 7.7°, 16.5°, 25.1°, and 26.6° to CuKα characteristic X-ray in the X-ray diffraction spectrum.

5. An electrophotographic photoreceptor as claimed in claim 4, wherein said methoxy gallium phthalocyanine crystal is represented by formula (II):

(II)

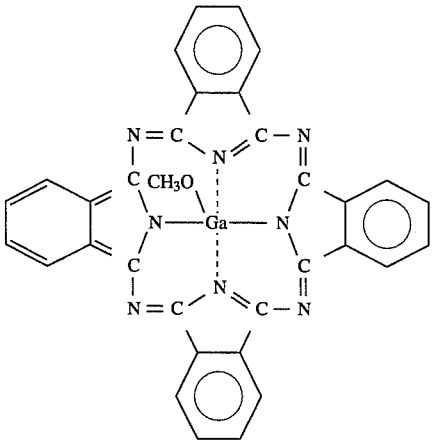

6. An electrophotographic photoreceptor as claimed in claim 4, wherein said methoxy gallium phthalocyanine crystal has a distinct absorption peak at 558 $cm^{-1}$ in an IR absorption spectrum.

7. An electrophotographic photoreceptor as claimed in claim 1, wherein said photosensitive layer further comprises a charge transfer material.

8. An electrophotographic photoreceptor as claimed in claim 1, wherein said electrophotographic photoreceptor further comprises a charge transfer layer.

9. An electrophotographic photoreceptor comprising an electrically conductive support having thereon a photosensitive layer comprising a binder resin and a methoxy gallium phthalocyanine crystal represented by formula (I) as a charge generating material:

(I)

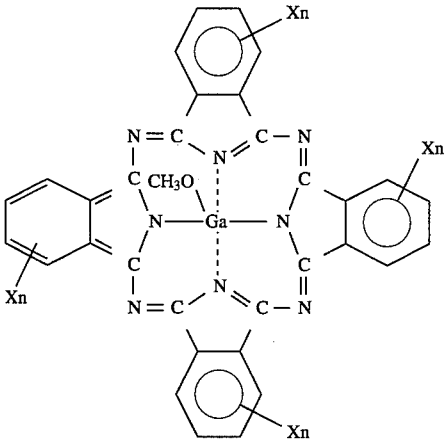

wherein X represents a chlorine atom, a bromine atom, or an iodine atom; and n represents an integer of from 0 to 4, wherein the ratio of said methoxy gallium phthalocyanine crystal to the binder resin is in the range of from 40/1 to 1/20 by weight.

10. An electrophotographic photoreceptor as claimed in claim 9, wherein said methoxy gallium phthalocyanine crystal has distinct diffraction peaks at Bragg angles (2θ±0.2°) of 7.7°, 16.5°, 25.1°, and 26.6° to CuKα characteristic X-ray in the X-ray diffraction spectrum.

* * * * *